United States Patent [19]

Helgeson

[11] 3,933,400

[45] Jan. 20, 1976

[54] REVOLVING KITCHEN PACKAGE

[75] Inventor: Peter L. Helgeson, Macungie, Pa.

[73] Assignee: Raytheon Company, Lexington, Mass.

[22] Filed: May 30, 1974

[21] Appl. No.: 474,834

[52] U.S. Cl. ..... 312/223; 52/65; 186/1; 312/100; 312/200; 312/229; 312/228; 312/242; 312/252; 4/192; 4/167

[51] Int. Cl.[2] ..... A47B 49/00; A47B 77/06; A47B 77/08; E04B 1/346

[58] Field of Search ..... 186/1 A, 1 D, 1 C, 1 R; 312/223, 236, 252; 52/31, 65

[56] References Cited

UNITED STATES PATENTS

| | | | |
|---|---|---|---|
| 2,226,925 | 12/1940 | Ehret | 312/223 |
| 2,261,514 | 11/1941 | Dunigan | 312/223 X |
| 2,563,531 | 8/1951 | Kirkman et al. | 52/65 |
| 2,627,445 | 2/1953 | Lyon | 312/223 |
| 2,712,974 | 7/1955 | Renna | 312/252 X |
| 2,968,363 | 1/1961 | Kinkaid | 186/1 R |
| 2,970,874 | 2/1961 | Honeycutt et al. | 312/223 |
| 3,039,565 | 6/1962 | Egner | 186/1 D |
| 3,298,461 | 1/1967 | Kinkaid | 186/1 R |
| 3,599,378 | 8/1971 | Kachnic | 52/65 X |
| 3,636,975 | 1/1972 | Kirkman et al. | 52/65 X |
| 3,694,046 | 9/1972 | Gehrmann | 312/236 X |
| 3,774,723 | 11/1973 | Johnston | 186/1 C |

*Primary Examiner*—Paul R. Gilliam
*Assistant Examiner*—Carl F. Pietruszka
*Attorney, Agent, or Firm*—Harold A. Murphy; Joseph D. Pannone; John T. Meaney

[57] ABSTRACT

A revolving kitchen package which includes a combination of various appliances and work areas assembled into a single unit revolvable within a wall section so as to present selected ones of the areas to particular regions on selected sides of the wall section.

2 Claims, 9 Drawing Figures

REVOLVING KITCHEN PACKAGE

BACKGROUND OF THE INVENTION

Modern living, especially in suitable climates, encompasses outdoor living in addition to indoor living. This is indicated by the proliferation of patio areas which have become commonly used as outdoor living areas. Where climates are not suitable for substantial amounts of outdoor living, indoor living is divided or separated into various activity areas. This is indicated by the prevalence of homes which include family rooms, dens, playrooms, game rooms or similar areas in addition to the usual functional kitchen, dining room, and the like.

It has become common practice to utilize the additional area to perform some of the functions which are normally performed in the kitchen, such as food preparation, cooking, and eating for example. In such cases it is usually necessary to provide duplication of appliances or appurtenances or to hand carry items between areas. Duplication is expensive and space consuming, while transporting entails effort and inconvenience.

The prior art is replete with devices such as furniture built into a wall as a movable part thereof, or food servers in the form of rotatable tables which revolve through wall apertures. None of these devices, however, provides a means for presenting any one of several work areas selectively to regions on remote sides of separating walls.

SUMMARY OF THE INVENTION

The present overcomes the above and other disadvantages of the prior art by providing a unit comprising a group of work areas and/or appliance areas which are assembled into a single unit revolvably mounted in a wall or in a juncture between a plurality of walls so as to form in itself a wall section, the unit being movable about a central axis so as to selectively present a desired particular area to a selected region within or without the walls. The unit may comprise, for example, a cooking area with a top cooking surface and an oven, a refrigeration area, a sink and cleaning area, a food preparation and storage area, and other areas, each with its own electrical and plumbing facilities, as required.

It will be apparent that the cooking area could be used in the kitchen region or a patio region, or even in a third region such as a family room, which regions are all separated from one another by walls.

The assembled unit is driven electrically by a switch-actuated motor which revolves the unit, through suitable gearing, guided by a circular hidden track. Electrical and fluid plumbing, including drain, are provided through a novel coupling whereby rotation of the unit is permitted without fouling of the coupling.

Thus, a selected work area may be presented to a desired region, indoor and outdoor, by operation of a switch, thus eliminating the need for either duplication of work areas or hand carrying between regions.

BRIEF DESCRIPTION OF THE DRAWINGS

The above and other objectives of this invention will be apparent from the following description taken in connection with the accompanying drawings, wherein.

DESCRIPTION OF THE PREFERRED EMBODIMENT

Figure 1:
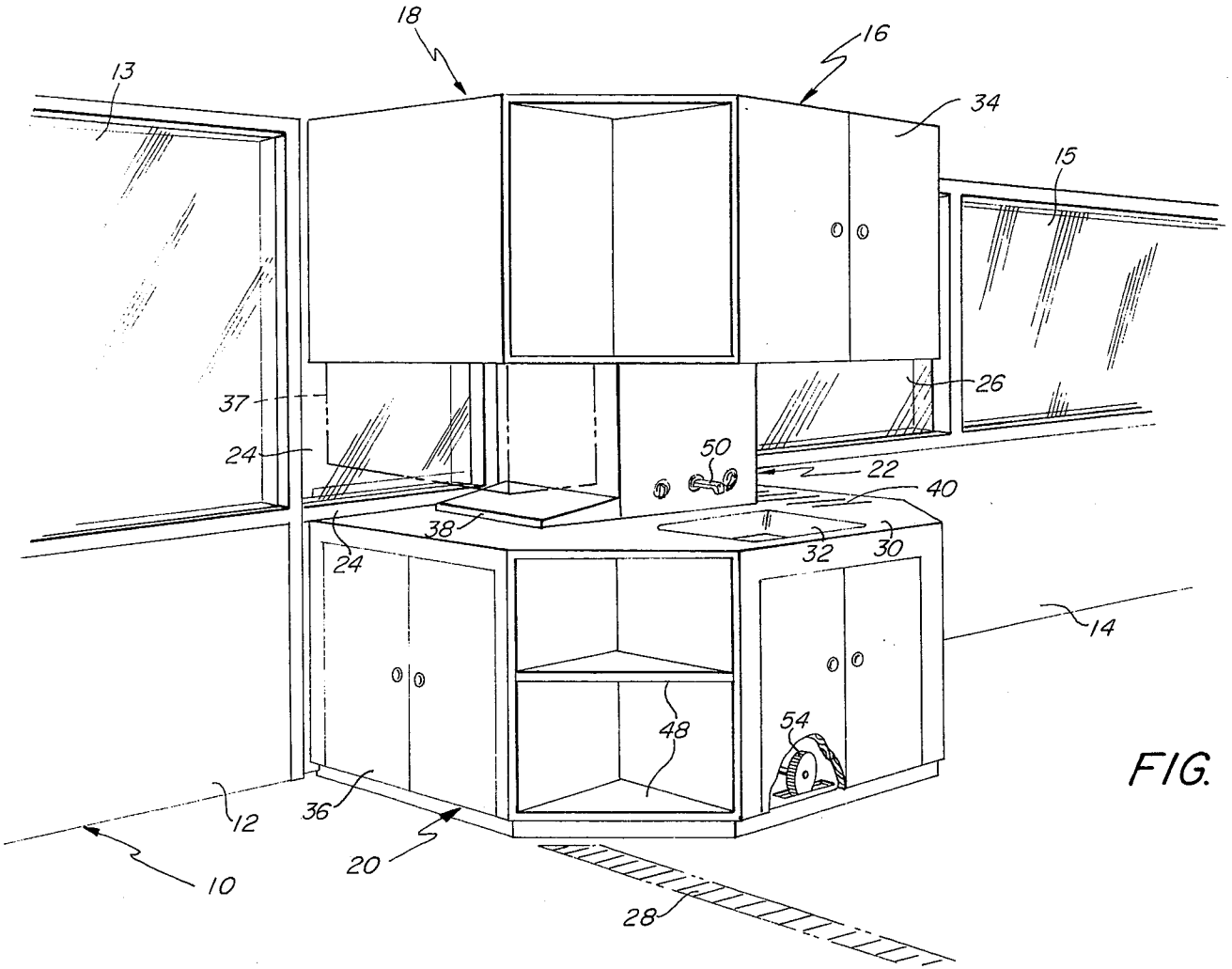
FIG. 1 is a pictorial elevational view of an embodiment of the invention.

Referring more particularly to the drawings wherein like characters of reference designate like parts throughout the several views, in FIG. 1 there is shown a wall 10 having a first section 12 and a second section 14 which lie substantially in a common plane in spaced end-to-end alignment. Wall sections 12 and 14 may include respective windows 13 and 15 if desired.

Within the space between adjacent ends of wall sections 12 and 14 is a kitchen package 16 embodying the invention. Package 16 comprises a grouping of selected appliances and work areas arranged side-by-side in a somewhat circular fashion around a central vertical axis, including a first large diameter grouping 18 at the top, a second large diameter grouping 20 at the bottom, and an interconnecting pedestal portion 22 between the two groupings 18 and 20.

The overall diameter of top and bottom groupings 18 and 20 are substantially equal and are adapted to fit into the space between wall sections 12 and 14 as shown. Short extensions 24 and 26 of respective wall sections 12 and 14 are shaped to occupy space between the top and bottom wall sections 18 and 20 on either side of the pedestal 22 and may be primarily comprised of glass.

The assembled package 16 is adapted to rotate about its central axis, in a manner to be described, within the opening between wall sections. To adequately perform this function, the axis of rotation lies substantially inwardly of the wall 10 within the interior portion of the house, whereby only one work or appliance area will be located at one time in the exterior patio area. However, it is to be understood that in some installations it may be desirable to provide the larger number of areas at the exterior, in which case the axis of rotation will be disposed on the exterior side of the wall 10.

Figure 2:
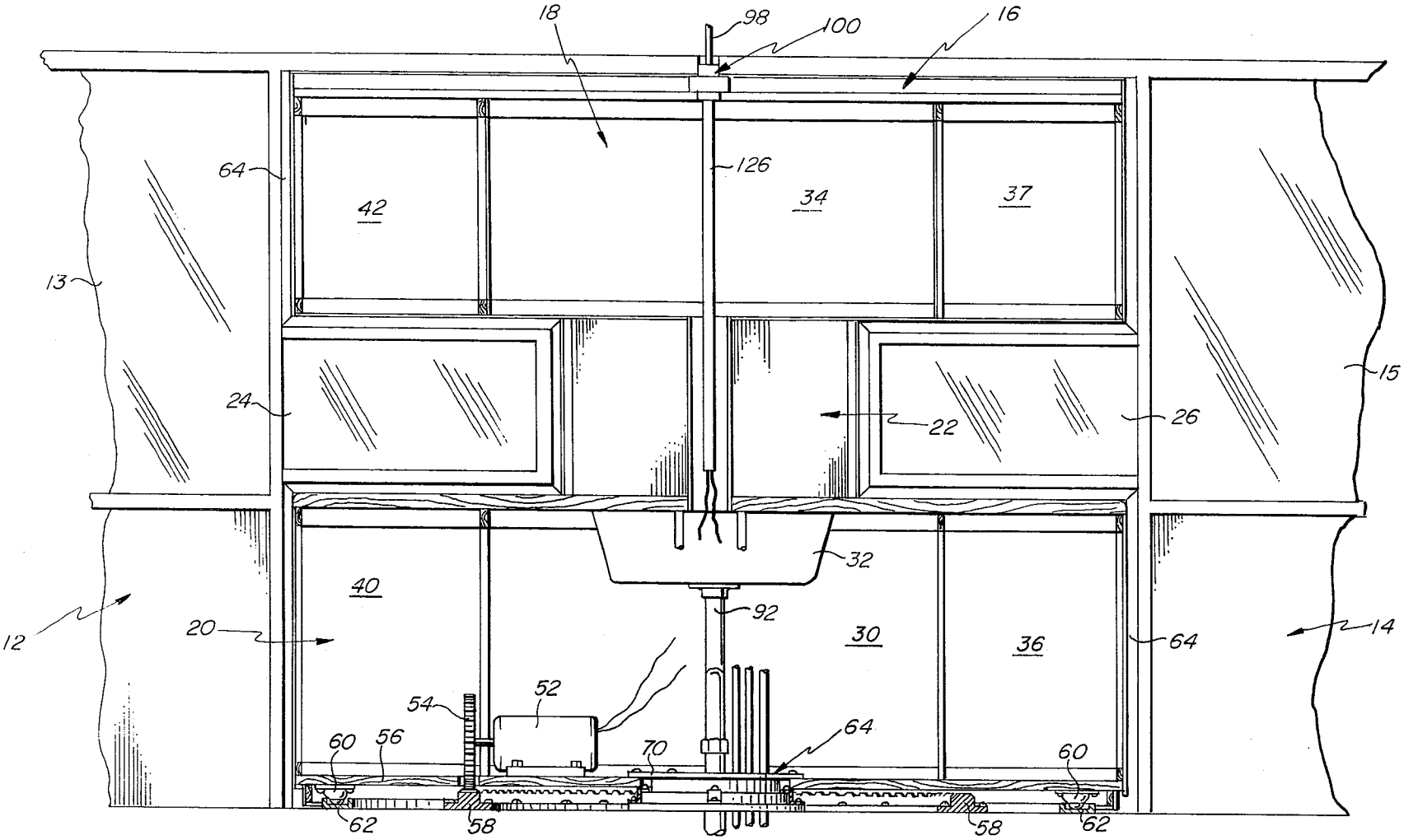
FIG. 2 is an enlarged axial sectional view of the structure shown in FIG. 1.

In the arrangement shown in FIGS. 1 and 2, a third wall section 28 within the interior may be positioned so as to provide access to one of the work or appliance areas from a third region, if desired. In this case the package 16 will be located as shown in an opening in third wall section 28 at its juncture with wall sections 12 and 14. This arrangement is particularly suitable where a kitchen and a family room adjoin and it is desired to provide ready access to the kitchen package from either room as well as from the patio.

While the package 16 may comprise any selected arrangement of appliances and work areas, one suggested arrangement is depicted in the drawings. Bottom grouping 20 is shown as including a preparation area 30 including sink 32, disposer and storage cabinet, and above it in top grouping 16 is a storage cabinet 34. An adjacent bottom area is a "planning" area including dishwasher 36 having above it, in top grouping 16, a pull-down refrigerator or freezer 37 and a calculator 38. The next area is a heating area including, in the bottom grouping, a surface cooking unit 40 and oven, and above, in the upper grouping 16, a pull-down upper oven 42. The fourth area, in lower grouping 20, includes another preparation area with a refrigerator, canister dispenser, etc. 44, and above it a pull-down freezer 46. Shelves 48 are conveniently located between adjacent areas at corners of the package. Controls for appliances, as necessary, may be placed on adjacent surfaces of the pedestal 22, including faucet 56 etc. for the sink. Electrical controls for the heating, refrigerating, dishwashing and other electrical units, as well as suitable electrical outlets, are also located on the pedestal. The plumbing and electrical connections will be described hereinafter.

To revolve the package 16, switches (not shown) are conveniently located in each region for energization of a motor and gear train 52 (FIG. 2) which are mounted on floor 56 of the package and which rotates a gear 54 located within a lower portion of the package. Gear 54 projects through the floor 56 and meshes with a cog rail 58 which is suitably fixed to any base or platform on which the package is located. Rail 58 is annular in shape and, therefore, the package will rotate about its vertical axis which coincides with the center of the rail. Roller bearings 60 are provided at selected intervals on the bottom of floor 56 for engagement with a concentric annular track 62 for supporting and guiding the package.

Around the entire periphery of the opening in the wall 10 there is provided suitable weather-protecting means such as a flexible flap 64 to adjustably seal the gap between wall and package.

Figure 9:
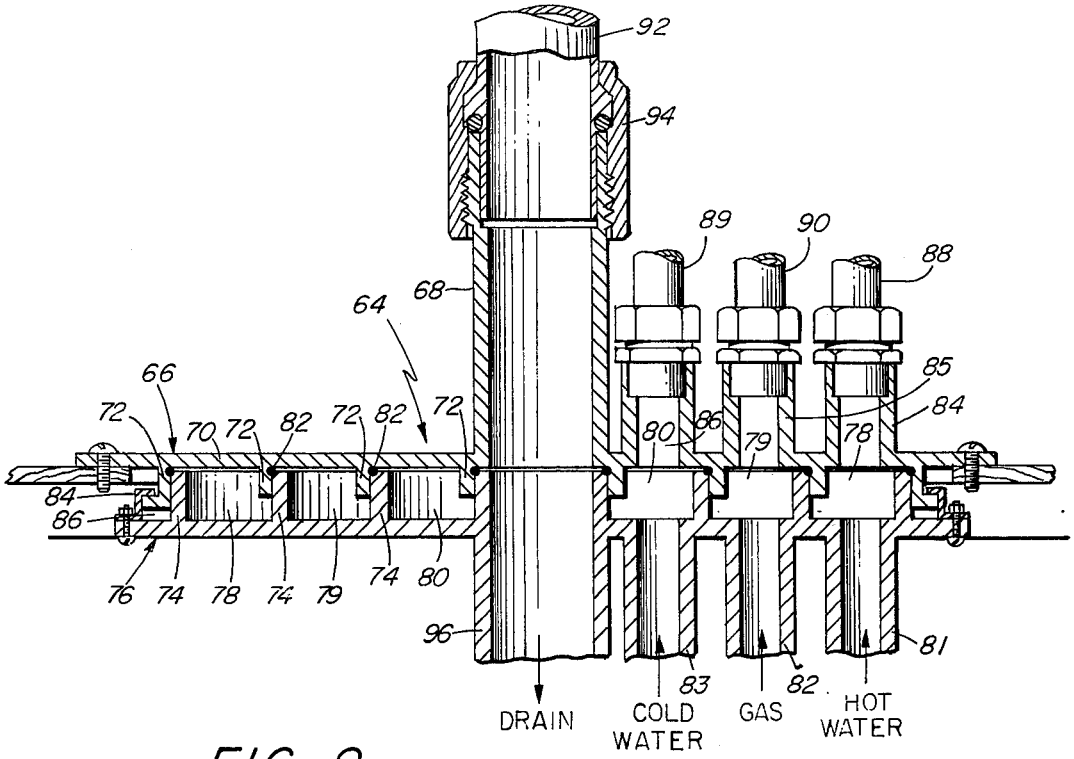
FIG. 9 is a vertical sectional view through the plumbing coupling.

The plumbing is effectively provided through a novel coupling 64 which is shown in detail in FIG. 9. The coupling 64 includes a movable upper element 66 which includes a central drain pipe section 68 and a disclike member 70 which is bolted or otherwise fixed to floor 56 for rotating movement with the package. Member 70 is provided with a number of downwardly directed annular concentric rings 72 which nest within similar upwardly directed concentric rings 74 which are provided on the upper surface of a fixed base member 76 of the coupling. Base member 76 is immovably fixed to any stationary base or platform and, therefore, will not revolve. Consequently, rings 72 of the upper member 66 will frictionally rotate around rings 74 of the lower member 76.

The spacing between pairs of adjoining rings 72–74 provide open channels 78, 79 and 80 which are annular in shape. O-ring seals 82 are provided between the respective rings in each pair to prevent leakage of fluids from the channels, and rigid clips 84 are attached at intervals around the periphery of the base member 76 to engage a lip 86 on outer ring 72 of member 66 to constantly retain the seals 82 in compression between the rings.

Connected to each channel 78, 79 and 80 within fixed base member 76 is a respective inlet pipe 81, 82 and 83. Also, connected to each channel 78, 79 and 80 within the movable member 66 is a respective outlet pipe 84, 85 and 86. Outlet pipes 84, 85 and 86 move with the coupling member 66 but always remain in communication with their respective channels.

Hot water, for example, may be injected into channel 78 via inlet pipe 81 and will then flow out of channel 78 via outlet pipe 84 and through additional piping 88 to the sink 32. Likewise, cold water which is injected by pipe 83 into channel 80 will flow out through pipe 86 and additional piping 89 to the sink 32. In the same manner, gas which is injected from pipe 82 into channel 79 will flow out through pipe 85 and additional piping 90 to the cooking appliances.

The drain 92 from sink 32 is attached by a coupling 94 to the drain pipe section 68 of upper coupling member 66, which pipe section 68 communicates directly with a similar outlet drain pipe section 96 of the fixed coupling member 76. Thus, all plumbing conveniences are provided for the package.

Figure 5:
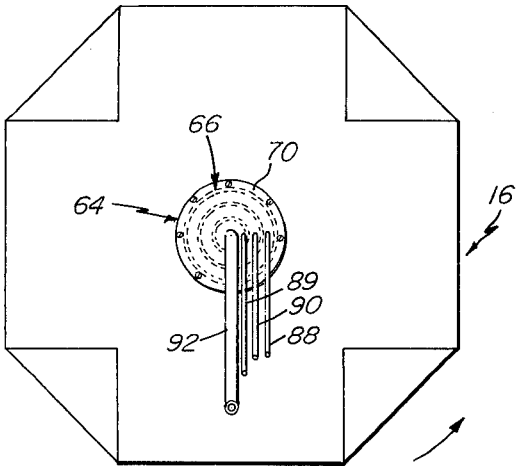
FIGS. 5–7 are diagrammatic views of the movable unit illustrating rotatable plumbing coupling.
Figure 6:
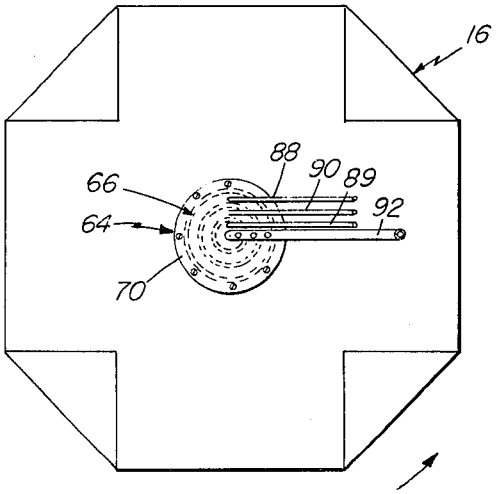
Figure 7:
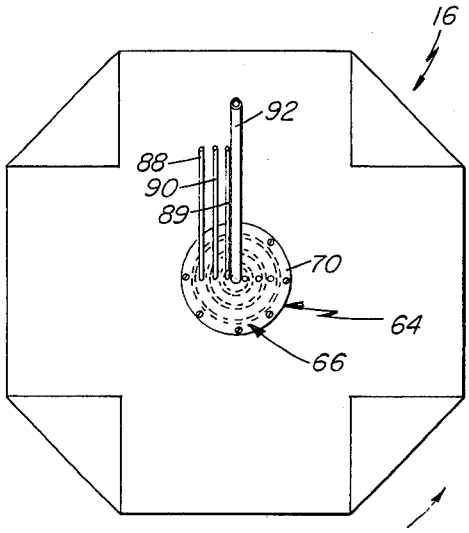

FIGS. 5, 6 and 7 illustrate various positions of the plumbing which forms a part of the kitchen package and shows how communication is maintained between this plumbing and the fixed outlet plumbing when the package is located in different positions.

Figure 8:
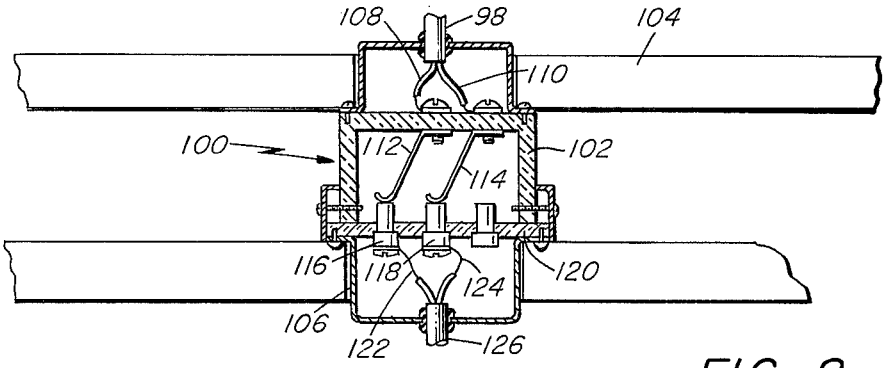
FIG. 8 is a vertical sectional view through a suggested electrical coupler.

Electrical wiring comprises a cable 98 (FIGS. 2 and 8) which may be connected to a source of electrical energy at one end and at its other end enters a terminal box 100 carried at the top of the package. Box 100 is fixed at its upper end portion 102 to a suitable support 104, and its lower portion 106 is fixed to the top of the package and is rotatable with respect to the upper portion 102 so that it can revolve with the package. The wires 108–110 of cable 98 are attached to respective terminal members in the fixed portion 102, which terminal members include flexible contacts 112–114 which engage a pair of fixed contacts 116–118 in the movable portion 106 of the box.

Contacts 116–118 are carried by a support member 120 which is fixed to box portion 106 for rotary movement therewith. When the package and box portion 106 revolve, the support member 120 and contacts 116–118 will also move. Thus, sliding contact between the flexible contacts 112–114 and fixed contacts 116–118 is maintained. Since all wiring into the package is taken from contacts 116–118, as by wires 122–124 of cable 126, no kinking of the wiring occurs. Cable 126 may extend downwardly through the pedestal 22 for connection to appliances and outlets as required.

Figure 3:
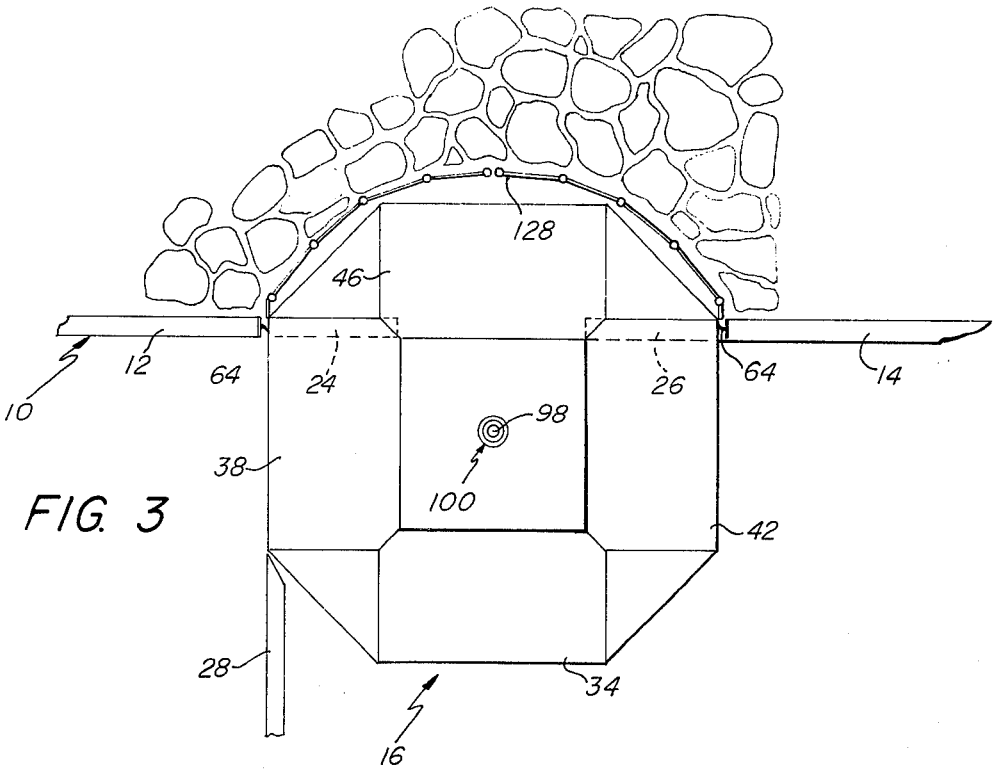
FIG. 3 is a schematic top plan view of the structure shown in FIG. 1.
Figure 4:
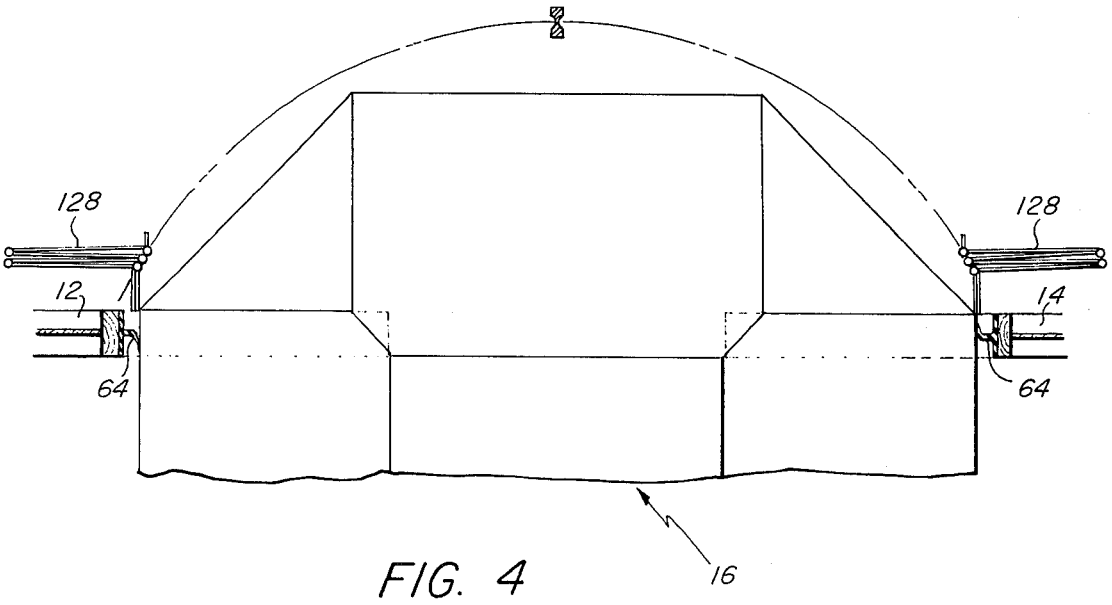
FIG. 4 is an enlarged schematic view of the patio screen structure.

In FIGS. 3 and 4 the kitchen package 16 is adapted to extend partly into a patio area. In such a case it is sometimes desirable to provide a folding screen or partition 128 to be moved into shielding relation to the package as shown. Such screen or partition may take any convenient form.

From the foregoing it will be apparent that all of the objectives of this invention have been achieved by the invention shown and described. It will be apparent, however, that various modifications and changes in the invention may be made by those skilled in the art without departing from the spirit of the invention as expressed in the accompanying claims. Therefore, all matter shown and described is to be interpreted as illustrative and not in a limiting sense.

I claim:

1. A kitchen package adapted for movable mounting within a wall comprising a group of selected appliances and conveniences assembled into a unit, means for rotating said unit about a vertical axis to locate selected ones of said appliances and conveniences in predetermined position with respect to said wall, one of said conveniences comprising a water-utilizing device having a water inlet and a drain, and coupling means comprising a first fixed member mounted on said support for connection to external drainage means and source of water, and a second member mounted on said unit for rotation therewith and connected in rotatable water-tight relation to said first member, said second member being connected to said drain and water inlet of said device, said coupling members having therein separate cooperating compartment means for conveying fluids to said water inlet and separately from said drain.

2. A kitchen package adapted for mounting within an opening in a wall and for rotation upon a base within said opening about a vertical axis, comprising spaced upper and lower groups of selected appliances and conveniences arranged in circular fashion around said axis, said groups being of substantially equal outside diametric size, a pedestal section of smaller diametric size interconnecting said groups and forming a unit therewith, said axis extending through said pedestal, means for rotating said unit about said axis on said base, water control elements located in said pedestal section for cooperative use with at least one of said conveniences, at least one of said conveniences comprising a drain and coupling means in said base comprising a first fixed member mounted on said base for connection to external drainage means and source of water, and a second member mounted on the unit for rotation therewith and connected in rotatable water-tight relation to said first member, said second member being connected to said drain of the device and to said water control elements in said pedestal section, said coupling members having separate cooperating compartment means therein for conveying water to said water control elements and for separately conveying fluids from said drain.

* * * * *